US008789924B2

(12) United States Patent
Bibl et al.

(10) Patent No.: US 8,789,924 B2
(45) Date of Patent: Jul. 29, 2014

(54) ACTUATABLE DEVICE WITH DIE AND INTEGRATED CIRCUIT ELEMENT

(71) Applicant: FUJIFILM Corporation, Tokyo (JP)

(72) Inventors: Andreas Bibl, Los Altos, CA (US); Deane A. Gardner, Cupertino, CA (US); John A. Higginson, Santa Clara, CA (US); Kevin von Essen, San Jose, CA (US)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/070,273

(22) Filed: Nov. 1, 2013

(65) Prior Publication Data

US 2014/0055528 A1 Feb. 27, 2014

Related U.S. Application Data

(62) Division of application No. 12/991,900, filed as application No. PCT/US2009/044185 on May 15, 2009, now Pat. No. 8,579,412.

(60) Provisional application No. 61/055,458, filed on May 22, 2008.

(51) Int. Cl.
*B41J 2/16* (2006.01)

(52) U.S. Cl.
USPC ..... 347/49; 347/50

(58) Field of Classification Search
CPC ..... B41J 2/14; B41J 2/16; B41J 2202/18; H01L 23/488; H01L 23/50; H01L 25/538; H01L 24/46; H01L 24/80
USPC ..... 347/5, 19, 40, 44, 49, 50, 56–59
See application file for complete search history.

(56) References Cited

U.S. PATENT DOCUMENTS 5,189,787 A 3/1993 Reed et al.
5,646,660 A 7/1997 Murray (Continued)

FOREIGN PATENT DOCUMENTS

CN 1982066 6/2007
CN 101124093 A 2/2008

(Continued)

OTHER PUBLICATIONS

Office action mailed Oct. 31, 2013 in corresponding Japanese Patent Application No. 2011-510604, 4 pgs.

(Continued)

*Primary Examiner* — Thinh Nguyen
(74) *Attorney, Agent, or Firm* — Fish & Richardson P.C.

(57) ABSTRACT

A fluid ejector includes a fluid ejection module and an integrated circuit element. The fluid ejection module includes a substrate having a plurality of fluid paths, a plurality of actuators, and a plurality of conductive traces, each actuator configured to cause a fluid to be ejected from a nozzle of an associated fluid path. The integrated circuit element is mounted on the fluid ejection module and is electrically connected with the conductive traces of the fluid ejection module such that an electrical connection of the module enables a signal sent to the fluid ejection module to be transmitted to the integrated circuit element, processed on the integrated circuit element, and output to the fluid ejection module to drive the actuator.

14 Claims, 8 Drawing Sheets

(56) References Cited

U.S. PATENT DOCUMENTS

| | | | | |
|---|---|---|---|---|
| 6,378,996 | B1 | 4/2002 | Shimada et al. | |
| 6,502,930 | B1 | 1/2003 | Shimada et al. | |
| 6,616,270 | B1 | 9/2003 | Miyata et al. | |
| 6,755,511 | B1 | 6/2004 | Moynihan et al. | |
| 7,896,469 | B2 * | 3/2011 | Furukawa | 347/50 |
| 2004/0113994 | A1 | 6/2004 | Shinkai | |
| 2004/0252155 | A1 | 12/2004 | Hoisington et al. | |
| 2005/0200661 | A1 | 9/2005 | O-Hara et al. | |
| 2005/0243130 | A1 | 11/2005 | Essen et al. | |
| 2006/0158486 | A1 | 7/2006 | Bibl et al. | |
| 2006/0203018 | A1 | 9/2006 | Mason | |
| 2007/0139469 | A1 | 6/2007 | Yasuda et al. | |
| 2008/0079759 | A1 | 4/2008 | Nagashima | |

FOREIGN PATENT DOCUMENTS

| | | |
|---|---|---|
| JP | 03-175044 | 7/1991 |
| JP | 2001-162794 | 6/2001 |
| JP | 2004-136663 | 5/2004 |
| WO | 2006/066102 | 6/2006 |
| WO | 2009/143025 | 11/2009 |

OTHER PUBLICATIONS

International Search Report and Written Opinion dated Sep. 2, 2009 issued in international application No. PCT/US2009/044185, 16 pgs.
Office Action dated Dec. 7, 2012 issued in Chinese application No. 200980118527.1, 22 pgs.
Office action mailed Jul. 1, 2013 in Japanese Patent Application No. 2011-510604 and partial translation, 5 pgs.

* cited by examiner

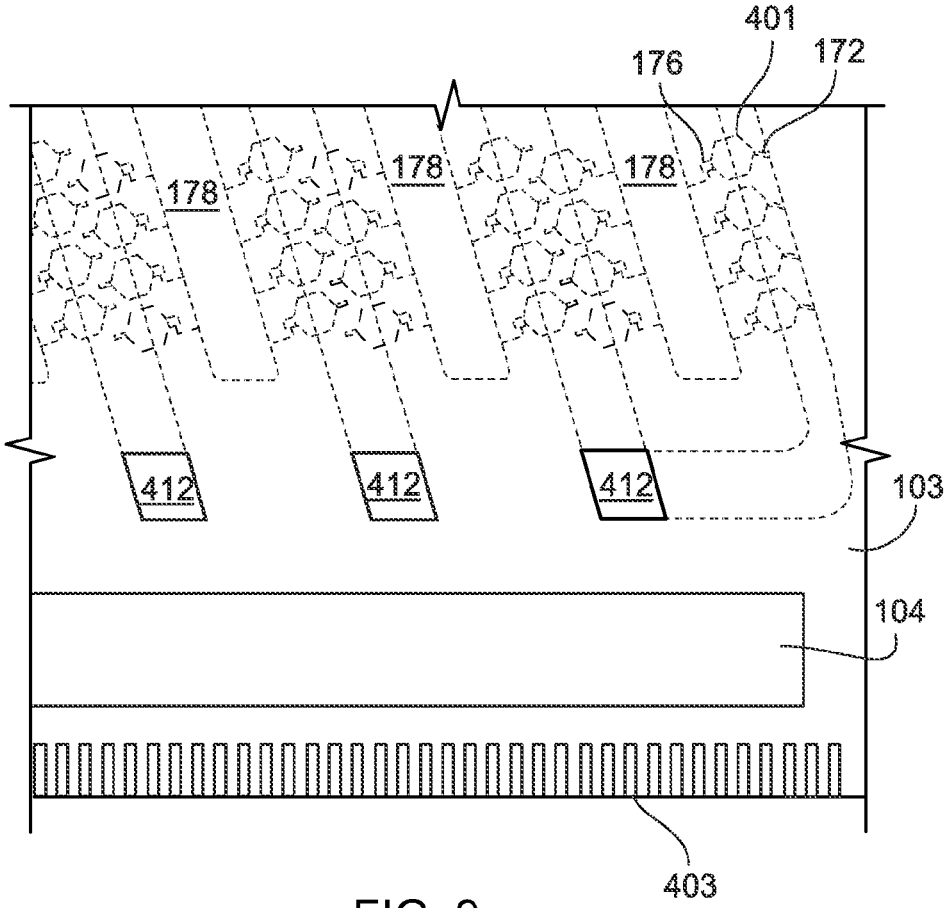
FIG. 9
FIG. 10
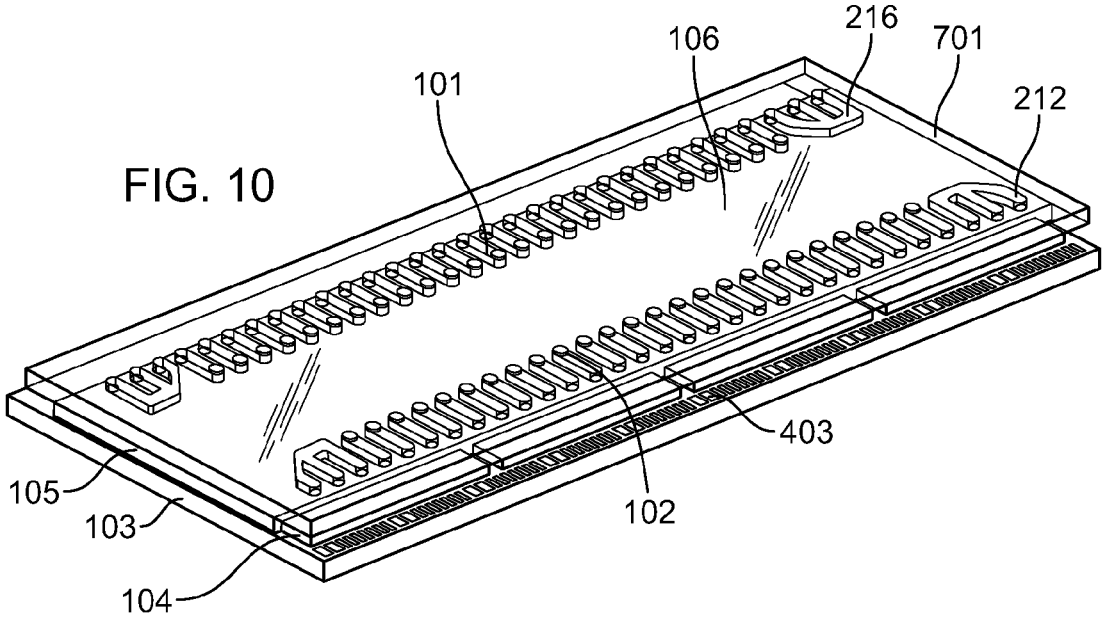

ACTUATABLE DEVICE WITH DIE AND INTEGRATED CIRCUIT ELEMENT

CROSS-REFERENCE TO RELATED APPLICATIONS

This application is a divisional of U.S. patent application Ser. No. 12/991,900, filed on Jan. 10, 2011, which is the national stage of International Application Number PCT/US2009/044185, filed on May 15, 2009, which is based on and claims the benefit of the filing date of U.S. Provisional Application No. 61/055,458, filed on May 22, 2008, each of which is incorporated herein by reference in its entirety.

BACKGROUND

This disclosure relates to electrically connecting integrated circuits to a die with actuatable devices.

Microelectromechanical systems, or MEMS-based devices, can be used in a variety of applications, such as accelerometers, gyroscopes, pressure sensors or transducers, displays, optical switching, and fluid ejection. Typically, one or more individual devices are formed on a single die, such as a die formed of an insulating material or a semiconducting material, which can be processed using semiconducting processing techniques, such as photolithography, deposition, or etching.

One conventional type of fluid ejection module includes a die with a plurality of fluid ejectors for ejecting fluid and a flexible printed circuit ("flex circuit") for communicating signals to the die. The die includes nozzles, ink ejection elements, and electrical contacts. The flex circuit includes leads to connect the electrical contacts of the die with driving circuits, e.g., integrated circuits that generate a drive signal for controlling ink ejection from the nozzles. In some conventional inkjet modules, the integrated circuits can be mounted on the flex circuit.

The density of nozzles in the fluid ejection module has increased as fabrication methods improve. For example, MEMS-based devices, frequently fabricated on silicon wafers, are formed in dies with a smaller footprint and with a nozzle density higher than previously formed. However, the smaller footprint of such devices can reduce the area available for electrical contacts on the die.

SUMMARY

A fluid ejection module that includes a die and an integrated circuit element to provide signals to control the operation of fluid ejection elements in or on the die is described.

In one aspect, a fluid ejector includes a fluid ejection module and an integrated circuit element. The fluid ejector module includes a substrate having a plurality of fluid paths, a plurality of actuators, and a plurality of conductive traces, each actuator configured to cause a fluid to be ejected from a nozzle of an associated fluid path. The integrated circuit element is mounted on the fluid ejection module and is electrically connected with the conductive traces of the fluid ejection module such that an electrical connection of the module enables a signal sent to the fluid ejection module to be transmitted to the integrated circuit element, processed on the integrated circuit element, and output to the fluid ejection module to drive the actuator.

Implementations can include one or more of the following features. The fluid ejection module can be formed of silicon. The actuator can include a piezoelectric element or a heater element. The fluid ejection module and the integrated circuit element can be adhered with a non-conductive paste or an anisotropic paste. A flexible element can be in electrical connection with the fluid ejection module such that the signal sent to the fluid ejection module is transmitted from the flexible element. The flexible element can be formed on a plastic substrate. The fluid ejection module can include an input trace and a first input pad, wherein the input trace is electrically connected to the flexible element, and wherein the first input pad is electrically connected to the actuator, and the integrated circuit element can include an integrated switching element, a second input pad connected to the input trace of the fluid ejection module, and an output pad connected to the first input pad of the fluid ejection module, wherein the integrated switching element is connected to the second input pad and the output pad. The second input pad and the output pad can be located on a surface of the integrated circuit element that is adjacent to the fluid ejection module. There can be a number of output pads and a number of actuators and the number of output pads and the number of fluid ejection elements are equivalent. There can be a number of output pads and a number of actuators, and the number of output pads can be less than the number of actuators, and there can be plurality of integrated circuit elements for a single fluid ejection module. There can be a number of output pads and a number of input traces and the number of output pads is greater than the number of input traces. There can be a number of first input pads and a number of actuators and the number of first input pads and the number of output pads is equivalent. There can be a number of first input pads and a number of output pads and the first input pads and the output pads can be adjacent to each other. There can be a number of input traces and a number of second input pads and the number of input traces can be equivalent to the number of second input pads. The input traces and second input pads can be adjacent to each other. There can be a number of first input traces and a number of output pads and the number of input traces can be smaller than the number of output pads. There can be a number of input traces and a number of fluid ejection elements and the number of input traces is smaller than the number of fluid ejection elements. The flexible element and the input trace can be adhered together with a non conductive paste or an anisotropic paste.

In another aspect, a fluid ejector includes a fluid ejection module comprising a fluid ejection element and a nozzle for ejecting a fluid when an actuator is actuated, an integrated circuit element in electrical communication with the fluid ejection module, and a first interposer configured to protect the fluid ejection element and integrated circuit element from fluid that is routed into the fluid ejection module.

Implementations can include one or more of the following features. A first side of the fluid ejection module and first side of the first interposer can be bonded with an adhesive. The first interposer can have a bonded area, wherein the bonded surface area surrounds a fluid inlet and is less than the area of the first side of the first interposer. A second interposer can be adjacent to the first interposer. The first interposer can be between the fluid ejection module and the second interposer and a first edge of the second interposer is longer than a first edge of the first interposer. The first interposer can have fluid inlets and fluid outlets that are in fluid connection with fluid inlets and fluid outlets of the second interposer. The fluid inlets and fluid outlets of the second interposer can be closer to a center of the second interposer than the fluid inlets and fluid outlets of the first interposer are to a center of the first interposer. The first interposer and second interposer can be bonded with an adhesive.

In another aspect, a fluid ejector includes a printhead module including a plurality of individually controllable piezoelectric actuators and a plurality of nozzles for ejecting fluid when the plurality of piezoelectric actuators are actuated, wherein the plurality of piezoelectric actuators and the plurality of nozzles are arranged in a matrix such that droplets of fluid can be dispensed onto a media in a single pass to form a line of pixels on the media with a density greater than 600 dpi.

Implementations pf either of these two aspects can include one or more of the following features. The plurality of piezoelectric actuators and plurality of nozzles cam be arranged in a matrix such that droplets of fluid can be dispensed onto a media in a single pass to form a line of pixels on the media with a density greater than 1200 dpi. The matrix can include 32 rows and 64 columns. There may be more than 2,000 nozzles in an area that is less than one square inch, wherein one side of the area is greater than one inch. The plurality of nozzles may include between 550 and 60,000 nozzles over an area that is less than 1 square inch. The plurality of nozzles may be configured to eject fluid having a droplet size of between 0.1 pL and 100 pL. A first side of the plurality of nozzles can be attached to a first side of the printhead module, and the area of the first side of the printhead module can be larger than the area of the of the first side of the plurality of nozzles. An integrated circuit element can directly contacts the printhead module and can be electrically connected with the printhead module such that an electrical connection of the module enables a signal sent to the printhead module to be transmitted to the integrated circuit element, processed on the integrated circuit element, and output to the printhead module to drive the plurality of actuators.

In another aspect, a fluid ejection system includes a printhead module including a plurality of individually controllable piezoelectric actuators and a plurality of nozzles for ejecting fluid when the plurality of piezoelectric actuators are actuated, wherein the plurality of piezoelectric actuators and the plurality of nozzles are arranged in a matrix, and a print bar configured such that when a media moves past the print bar, droplets of fluid can be dispensed from the plurality of nozzles onto the media in a single pass to form a line of pixels on the media with a density greater than 600 dpi.

Some implementations may include one or more of the following advantages. When there are fewer input traces on the die than output pads on the integrated circuit elements or ejection elements, a high density nozzle matrix can be formed without the electrical connection problems that can result from a high density of electrical contacts. The electrical connection can be further improved by using materials for the integrated circuit element and die that have a small difference in thermal expansion. Furthermore, interposers can separate fluid ejection elements from the external environment, such as fluid, to avoid damaging the fluid ejection elements. Shifting the fluid inlets and fluid outlets of an upper interposer to the center of the upper interposer can allow other components to adhere to the interposer while preventing an excessive adhesive from flowing into the fluid inlets.

Many of the techniques described herein can be applied to MEMS-based devices other than fluid ejectors.

Other features and advantages of the present invention will become apparent from the claims and following description.

BRIEF DESCRIPTION OF THE FIGURES

FIG. 9 is a cross-sectional plan view of a die with actuators arranged in a matrix.

FIG. 10 is a schematic semi-transparent perspective view of a die with a lower and upper interposer.

DETAILED DESCRIPTION

Figure 1A:
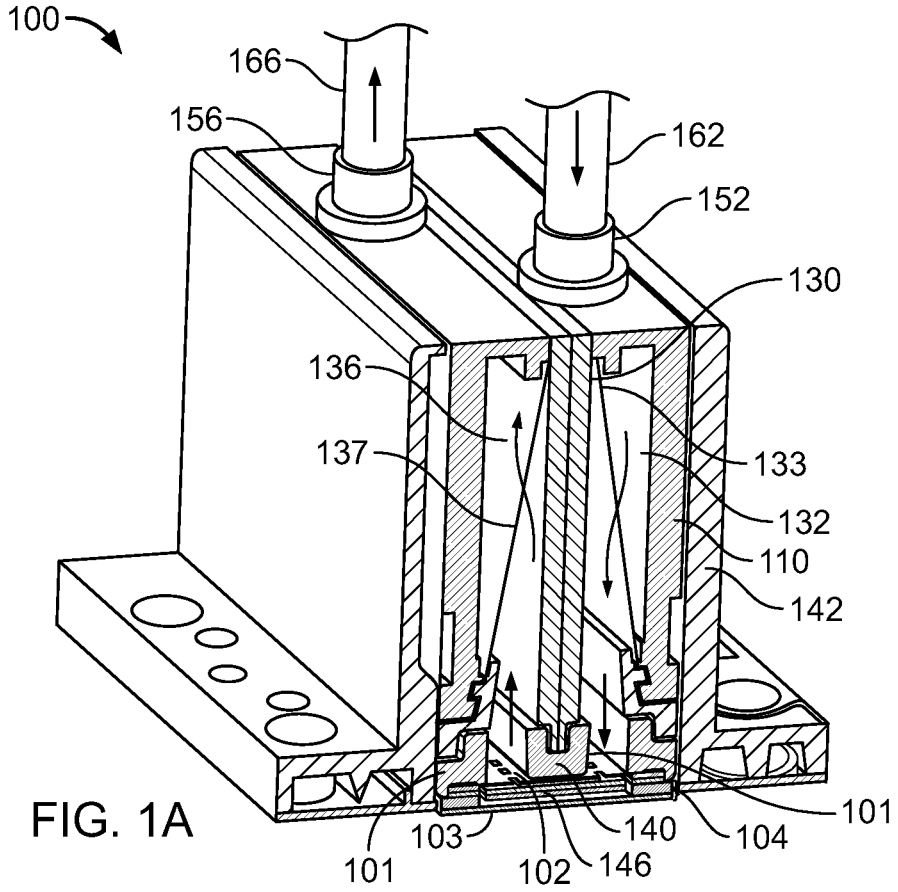
FIG. 1A is schematic perspective sectional view of a housed fluid ejector.

A fluid ejector is described herein. An exemplary fluid ejector is shown in FIG. 1A. The fluid ejector 100 includes a fluid ejection module, e.g., a quadrilateral plate-shaped printhead module, which can be a die 103 fabricated using semiconductor processing techniques. Fluid ejection modules are also described in U.S. Pat. No. 7,052,117, which is incorporated herein. The fluid ejected from the fluid ejector 100 can be ink, but the fluid ejector 100 can be suitable for other liquids, e.g., biological liquids, liquids for forming electronic components.

Each fluid ejector can also include a housing 110 to support and provide fluid to the die 103, along with other components such as a mounting frame 142 to connect the housing 110 to a print bar, and a flex circuit 201 (see FIG. 1B) to receive data from an external processor and provide drive signals to the die. The housing 110 can be divided by a dividing wall 130 to provide an inlet chamber 132 and an outlet chamber 136. Each chamber 132 and 136 can include a filter 133 and 137. Tubing 162 and 166 that carries the fluid can be connected to the chambers 132 and 136, respectively, through apertures 152 and 156. The dividing wall 130 can be held by a support 144 that sits on an interposer assembly 146 above the die 103.

A fluid ejection assembly, which includes the fluid ejection module 103 and the optional interposer assembly 146, includes fluid inlets 101 and fluid outlets 102 for allowing fluid to circulate from the inlet chamber 132, through the fluid ejection module 103, and into the outlet chamber 136. A portion of the fluid passing through the fluid ejection module 103 is ejected from the nozzles.

Figure 1B:
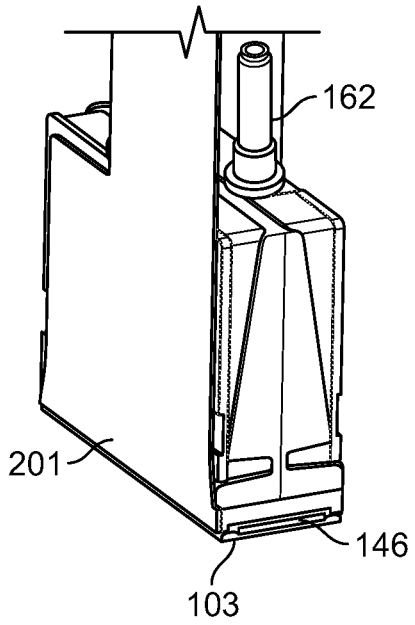
FIG. 1B is a schematic perspective view that illustrates the placement of the flex circuit in the housed fluid ejector.

Referring to FIG. 1B, a portion of the housing 110 of the fluid ejector is removed to show that the fluid ejector 100 includes a flexible printed circuit or flex circuit 201. The flex circuit 201 is configured to electrically connect the fluid ejector 100 to a printer system (not shown). The flex circuit 201 is used to transmit data, such as image data and timing signals, from an external processor of the printer system to the die 103 for driving fluid ejection elements on the fluid ejection module. The flex circuit 201 can also be used to connect a thermistor for fluid temperature control.

Figure 2:
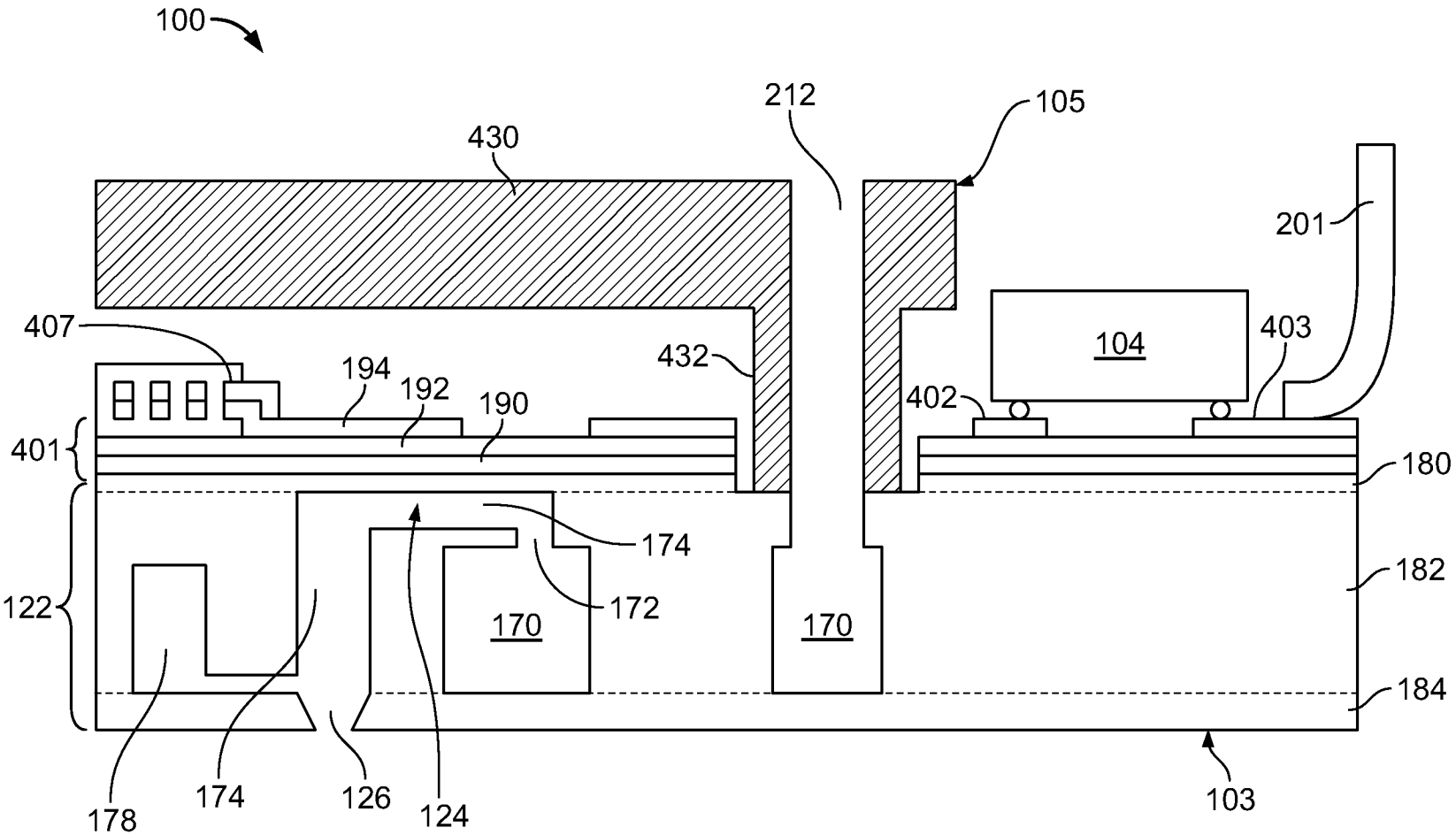
FIG. 2 is a schematic cross-sectional view of a die and an interposer.

Referring to FIG. 2, the fluid ejection module 103 can include a substrate 122 in which are formed fluid flow paths 124 that end in nozzles 126 (only one flow path is shown in FIG. 2). A single fluid path 124 includes an ink feed 170 (the two areas labeled 170 in FIG. 2 can be connected by a passage extending out of the page) an ascender 172, a pumping chamber 174, and a descender 176 that ends in the nozzle 126. The fluid path can further include a recirculation path 178 so that ink can flow through the ink flow path 124 even when fluid is not being ejected.

The substrate 122 can further include a flow-path body 182 in which the flow path is formed by semiconductor processing techniques, e.g., etching, a membrane 180, such as a layer of silicon, which seals one side of the pumping chamber 174, and a nozzle layer 184 through which the nozzle 128 is formed. The membrane 180, flow path body 182 and nozzle layer 184 can each be composed of a semiconductor material (e.g., single crystal silicon). The membrane can be relatively thin, such as less than 25 μm, for example about 12 μm.

The fluid ejection module 103 also includes individually controllable actuators 401 supported on a substrate 122 for causing fluid to be selectively ejected from the nozzles 126 of corresponding fluid paths 124 (only one actuator is shown in FIG. 2). Each flow path 124 with its associated actuator 401 provides an individually controllable MEMS fluid ejector unit.

In some embodiments, activation of the actuator 401 causes the membrane 180 to deflect into the pumping chamber 174, forcing fluid out of the nozzle 126. For example, the actuator 401 can be a piezoelectric actuator, and can include a lower conductive layer 190, a piezoelectric layer 192, and a patterned upper conductive layer 194. The piezoelectric layer 192 can be between e.g. about 1 and 25 microns thick, e.g., about 8 to 18 microns thick. Alternatively, the fluid ejection element can be a heating element.

Figure 3:
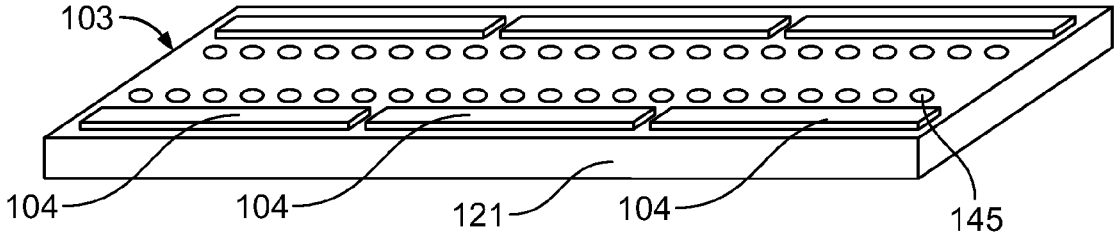
FIG. 3 is a schematic perspective view of a die on which integrated circuit elements are mounted.

Referring to FIGS. 2 and 3, the fluid ejector 100 further includes one or more integrated circuit elements 104 configured to provide electrical signals for control of ejection of fluid from the die 103 through nozzles located on the underside of the die 103. The integrated circuit element 104 can be a microchip, other than the die 103, in which integrated circuits are formed, e.g., by semiconductor fabrication and packaging techniques. Thus, the integrated circuits of the integrated circuit element 104 are formed in a separate semiconductor substrate from the substrate of the die 103. However, the integrated circuit element 104 can be mounted directly onto the die 103.

Figure 4:
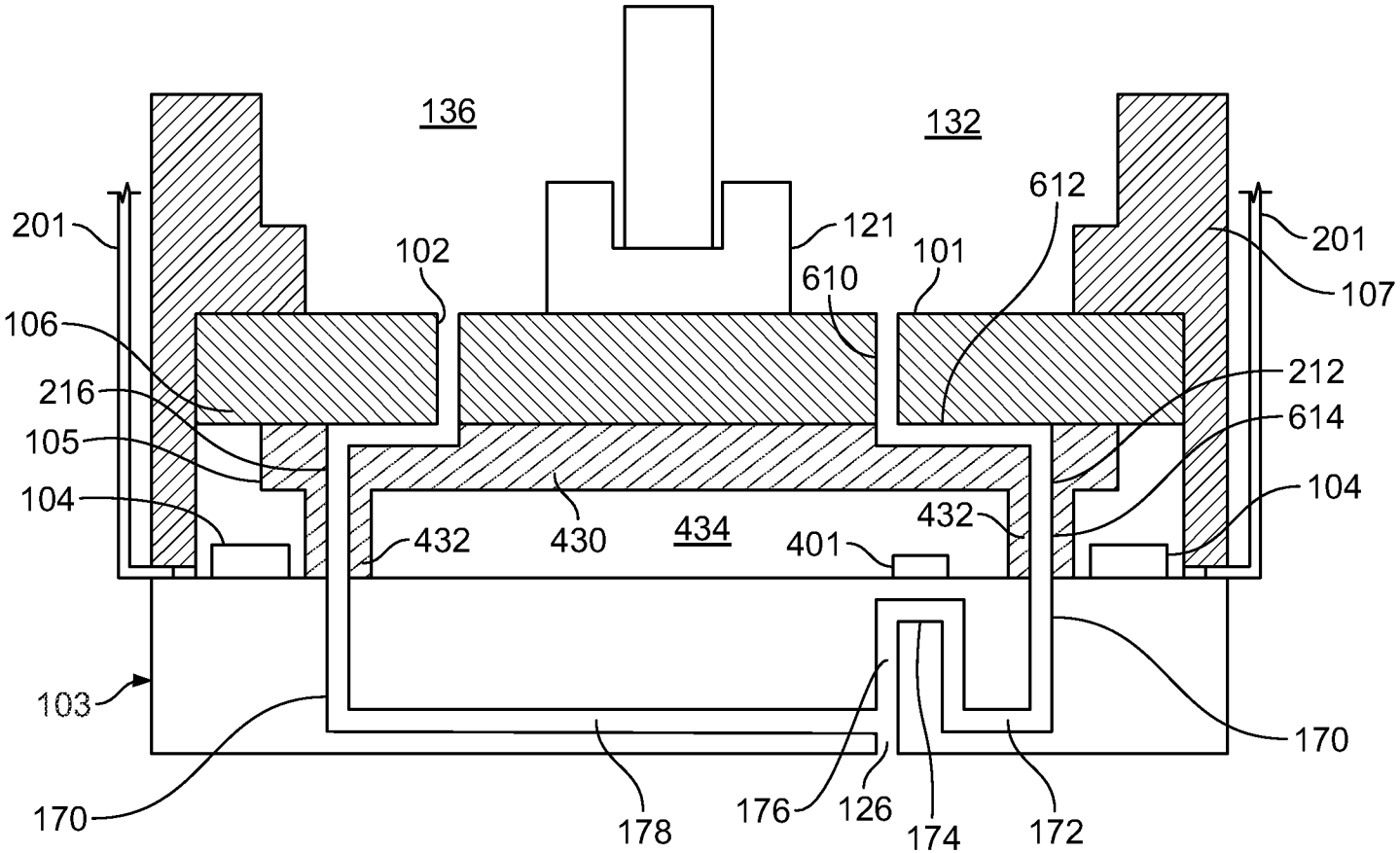
FIG. 4 is a schematic cross-sectional view of a fluid ejection module with an upper interposer and a lower interposer.

Referring to FIGS. 2 and 4, in some embodiments, the fluid ejection assembly of the fluid ejector 100 includes a lower interposer 105 to separate the fluid from the electrical components on the die 103 and/or the integrated circuit element 104. The fluid ejector 100 can include an upper interposer 106 to further separate the fluid from the electric components or integrated circuit element 104. Passages 212 and 216 through the combination of the upper interposer 106 and lower interposer 105 can allow for routing of fluid from/to a somewhat centralized location of the chambers 132 and 136 in the housing of the fluid ejector 100 to/from fluid inlets 412 and fluid outlets 414 that are closer to an edge of the die 103. Moreover, a fluid ejector containing a combination of the upper interposer 106 and lower interposer 105 can be easier to manufacture because the lower interposer 105 can be shorter in length than the upper interposer 106 to allow the integrated circuit elements 104 to rest in between the two interposers.

Referring to FIGS. 1 and 4, the fluid ejector 100 can also include a die cap 107 configured to seal a cavity in the fluid ejector 100 and to provide a bonding area for components of the fluid ejector that are used in conjunction with the die 103. The die cap 107 can also provide a bypass for ink recirculation above the die 103.

Figure 6:
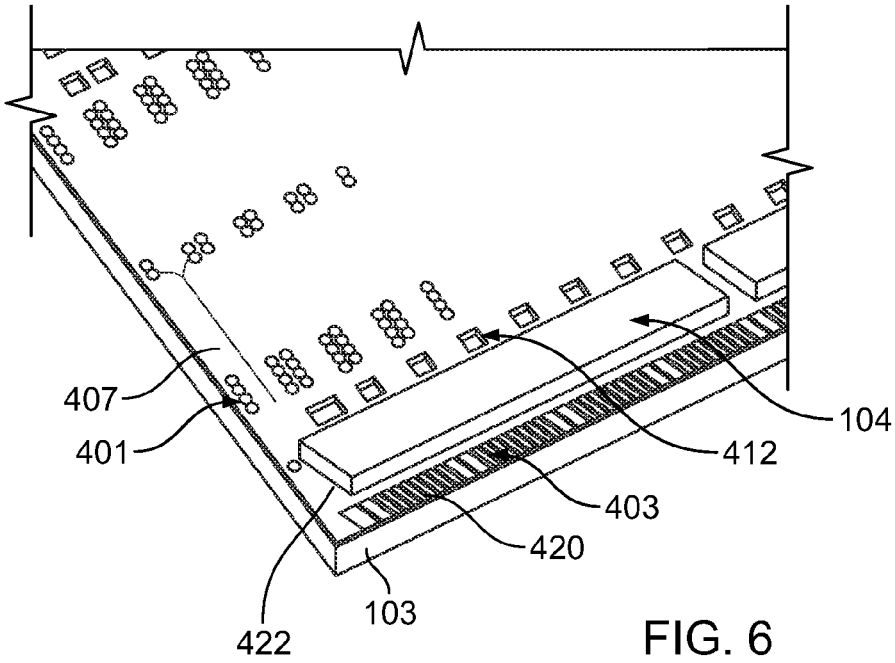
FIG. 6 is a simplified perspective view of a die with integrated circuit elements.
Figure 5:
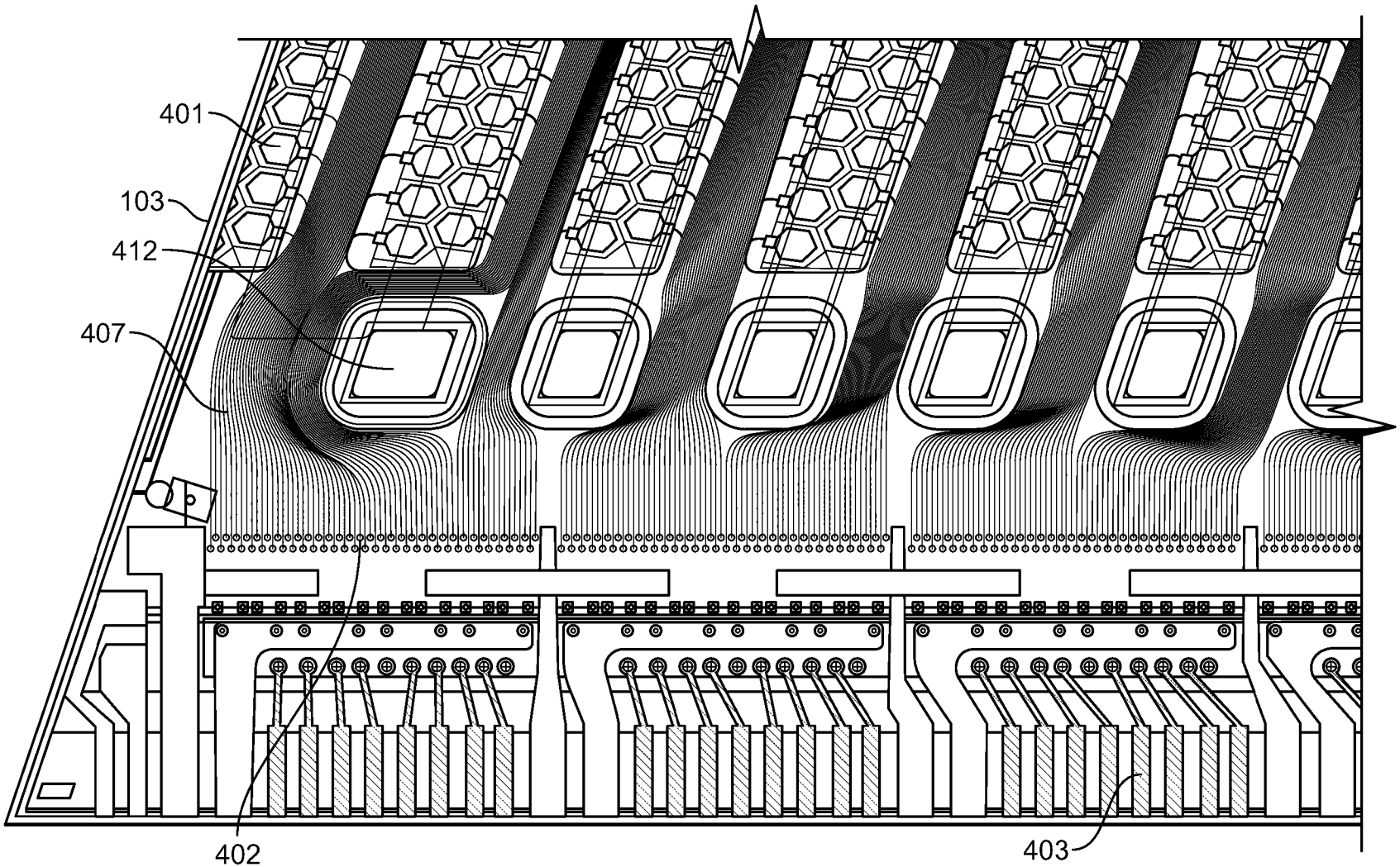
FIG. 5 is a plan view of a die with circuitry.

A plan and perspective partial view of an exemplary die having circuitry is shown in FIGS. 5 and 6, respectively. The multiple actuators 401 on the die 103 can be disposed in columns (FIG. 5 omits many of the actuators for simplicity). The actuators 401 shown in FIGS. 5 and 6 are piezoelectric elements, e.g., each actuator includes a piezoelectric layer between two electrodes. For each actuator 401, an electrode, e.g., the top electrode 194, is connected to a corresponding input pad 402 by way of a conductive trace 407 that is also located on the die 103 (FIG. 5 illustrates only a single trace 407 for simplicity). The traces 407 can extend between the columns of actuators 401.

In some embodiments, a fluid inlet 412 is formed at the end of a column of actuators 401. At an opposite end of the column, a fluid outlet 414 (not shown in FIGS. 5 and 6 but shown in FIGS. 3 and 4) can be formed in the top of the die 103. A single fluid inlet and fluid outlet pair can serve one, two, or more columns of fluid ejection elements 401. The passages 212 and 216 through the upper interposer 106 and lower interposer 105 fluidically connect the inlet 101 to the inlet 412 of the die 103, and the fluid outlet 414 of the die to the outlet 102. The die 103 further includes conductive input traces 403 arranged along one or more edges of the die 103. The traces 403 can have a pitch of about 40 microns or less, e.g., 36 micron pitch or 10 micron pitch. The flex circuit 201 (see FIG. 2) can be bonded into the input traces 403 of the die 103. For example, the flex circuit 201 can be connected to the distal ends 420 of the traces 403 at the edge of the die 103 (see FIG. 5). The bonding can be performed, for example, with paste, e.g., Non Conductive Paste (NCP) or Anisotropic Conductive Paste (ACP).

As shown in FIGS. 2, 3 and 6, the integrated circuit elements 104 can be mounted to the die 103 in a row extending in an elongated area between the input traces 403 and the inlets 412 or outlets 414. For example, a first row of integrated circuit elements 104 can be mounted to the die 103 in a first row extending in an elongated area between the input traces 403 on one edge of the die and the inlets 412, and a second first row of integrated circuit elements 104 can be mounted to the die 103 in a row extending in an elongated area between the input traces 403 on the opposite edge of the die and the outlets 414.

A perspective view of an exemplary die 103 with integrated circuit elements 104 mounted thereon is shown in FIG. 3. As noted above, the integrated circuit element 104 can be a separately fabricated die that is mounted on the die 103. In some implementation, the integrated circuit element 104 is an application-specific integrated circuit (ASIC) element. The integrated circuit element 104 can be a chip that can include, for example a die, packaging, and leads. The leads connecting the bond pads of the integrated circuit element 104 to electrical traces on the die 103 can be solder bumps (see FIG. 2) or wire bonds. For example, the leads can be gold bumps electroplated directly onto an aluminum bonding pad of the integrated circuit element 104. They can also be copper pillar bumps with a solder cap electroplated directly onto electrical pads of the integrated circuit element 104.

Figure 7:
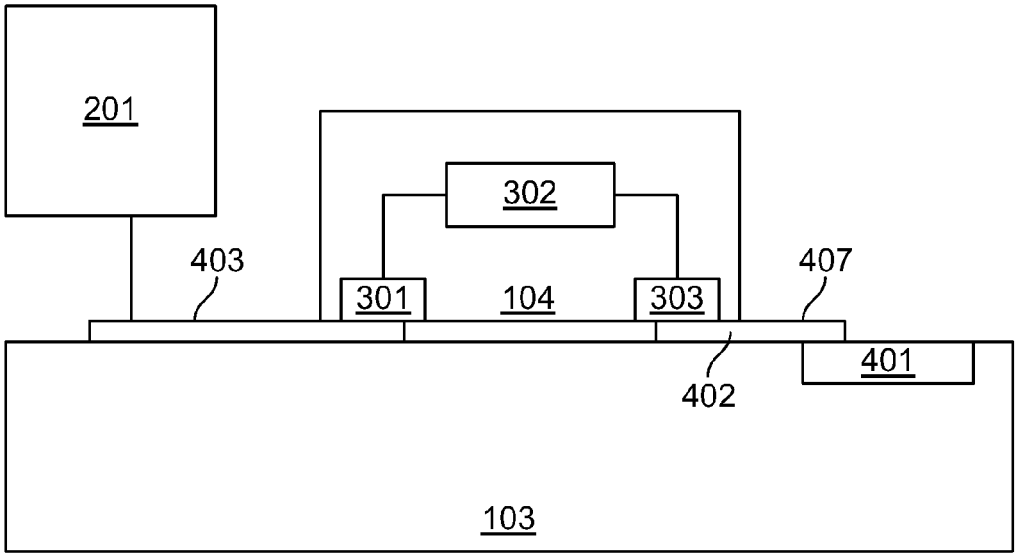
FIG. 7 is a schematic diagram of the electric connections between the flex circuit, die and integrated circuit elements.

The integrated circuit element 104 is configured to provide signals to control the operation of the actuators 401, as shown in FIG. 7. For example, integrated switching elements 302, e.g., transistors, in the integrated circuit element 104 can be connected to actuators 401 on the die with electrical contacts and leads. Thus, when a signal is sent from the flex circuit 201 to the input trace 403 on the die 103, it can be transmitted to an input pad 301 on the integrated circuit element 104, processed on the integrated circuit element 104, such as at the transistor 302, and output at an output pad 303 to the input pad 402 on the die 103, which is connected by the input trace 407 to drive the actuator 401.

The integrated circuit element 104 shown in FIG. 6 includes input pads 301 (see FIG. 7) that are connected to the input traces 403 on the die. For example, the input pads 301 on the integrated circuit elements 104 can be connected to the proximal ends 422 of the input traces 403, which are closer to a center of the die 103 than distal ends 420 of the input traces 403. The input pads 301 and input traces 403 can be connected using non-conductive paste (NCP), anisotropic conductive paste (ACP), or solder bumps on the integrated circuit elements 104. The input pads 301 (FIG. 3B) of the integrated circuit element 104 can be on the bottom surface of the integrated circuit element 104 to provide better electrical connection with the input traces 403 of the die 103.

As shown in FIG. 7, the integrated circuit element 104 also includes output pads 303 (that are connected to the input pads 301 of the integrated circuit element 104 through one or more integrated switching elements 302, e.g., an application specific integrated circuit (ASIC). Additionally, the output pads 303 on the integrated circuit element 104 are electrically connected to the input pads 402 of the die 103. The output pads 303 can be connected to the input pads 402 using NCP, ACP, or solder bumps on the integrated circuit elements 104. The output pads 303 on the integrated circuit element 104 can be on the bottom surface of the integrated circuit element 104 to provide better electrical connection with the input pads 402 on the die 103.

As noted, the integrated circuit element 104 includes integrated switching elements 302. Each switching element acts as an on/off switch to selectively connect the drive electrode of one MEMS fluid ejector unit to a common drive signal source. The common drive signal voltage is carried on one or more integrated circuit input pads 301, traces 403, and corresponding traces on flex circuit 201. The integrated switching elements 302 are connected to the input pads 301 of the integrated circuit element 104 and the output pads 303 of the integrated circuit element 104. Thus, the integrated circuit element 104 includes connections that are made internally, such as between the input pads 301, the integrated switching element 302, and the output pad 303.

Figure 8:
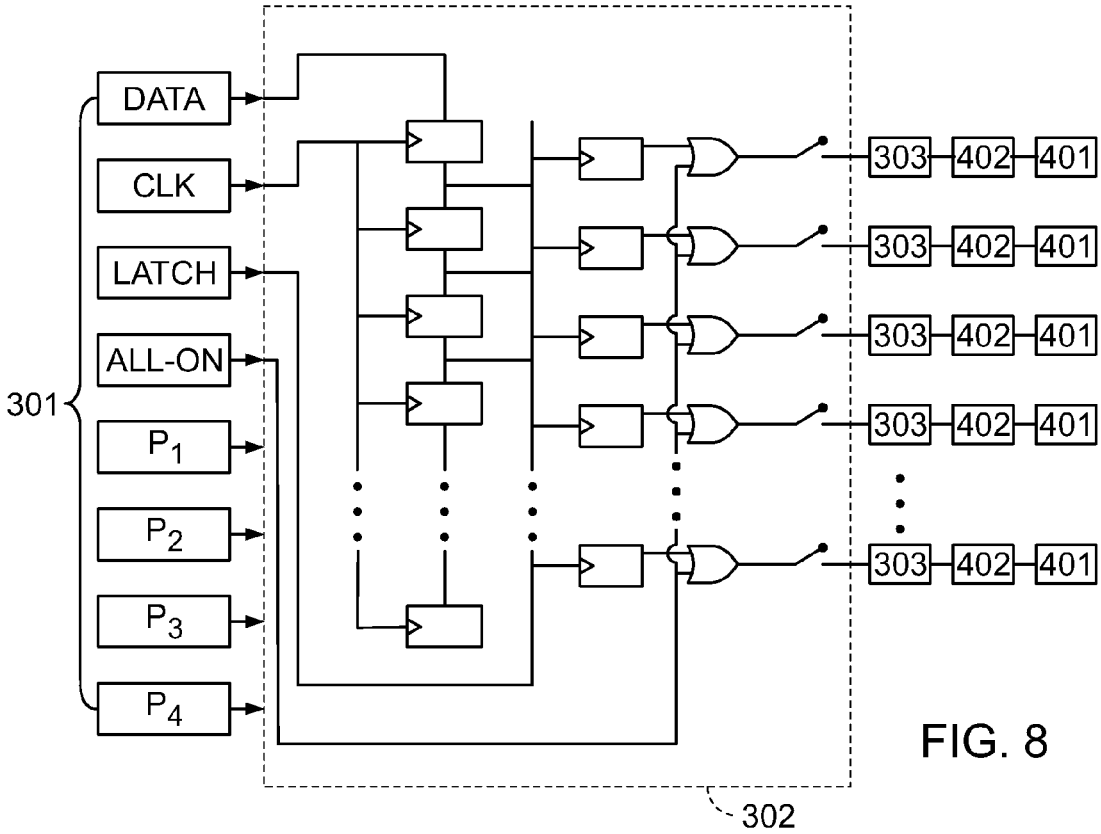
FIG. 8 is a circuit diagram of the flex circuit, die, and integrated circuit elements.

A circuit diagram of the flex circuit 201, integrated circuit 104, and die 103 is shown in FIG. 8. The input pads 301 of the integrated circuit 104 can include a clock line, data line, latch line, all-on line, and four power lines. Signals from the flex circuit 201 are sent through the input pads 301 to the integrated switching elements 302, which can include data flip-flops, latch flip-flops, OR-gates, and switches. A signal is processed by sending data through the data line to the data flip-flops. The clock line then clocks the data as it is entered. Data is serially entered such that the first bit of data that is entered in the first flip-flop shifts down as the next bit of data is entered. After all of the data flip-flops (e.g., 64 elements) contain data, then a pulse is sent through the latch line to shift the data from the data flip-flops to the latch flip-flops and onto the fluid ejection elements 401. If the signal from the latch flip-flop is high, then the switch is turned on and sends the signal through output pad 303 to input pad 402 to drive the fluid ejection element 401. If the signal is low, then the switch remains off and the fluid ejection element 401 is not activated.

One integrated circuit element 104 can include multiple integrated switching elements 302, such as 256 integrated switching elements. The number of integrated switching elements 302 can be the same as the number of actuators on the die 103 or a fraction thereof. Further, in some embodiments, the number of integrated switching elements 302 is equal to the number of input pads 301 on the integrated circuit 104. In some embodiments, each integrated switching element 302 is in electrical communication with more than one output pad 303.

The total number of the output pads 303 on all of the integrated circuit elements 104 corresponds to a number of input pads 402 and associated fluid ejection elements 401 on the die 103. There can also be additional pads that are used, for example, as heaters, temperature sensors, and grounds. If there is more than one integrated circuit element 104 on a single die 103, then the number of output pads 303 on the integrated circuit element 104 is a fraction of the number of fluid ejection elements 401. For example, if there are four integrated circuit elements 104 on a die 103, and there are 1024 fluid ejection elements 401 on the die 103, then each integrated circuit element 104 can have 256 output pads 303.

Each input pad 402 on the die 103 is electrically connected to a corresponding output pad 303 on the integrated circuit element 104. There can, however, be additional output pads 303 that are not connected or that are connected to other elements, such as grounds. Each corresponding pair of input pads 402 and output pads 303 are situated adjacent to each other so that they can be mated and electrically connected to one another. Likewise, each input trace 403 on the die 103 is electrically connected to a corresponding input pad 301 on the integrated circuit element 104. Each corresponding pair of input traces 403 and input pads 301 are situated adjacent to each other so that they can be mated and electrically connected to one another.

In some embodiments, the number of input traces 403 on the die 103 is smaller than the number of the input pads 402 and associated actuators 401 on the die 103. Moreover, there can be fewer input traces 403 that receive signals from the flex circuit 201 by using at least one serial data line, one clock line, and one latch line to control a plurality of integrated switch elements 302, such as 64 elements.

Advantageously, when there are fewer input traces 403 on the die 103 than output pads 303 on the integrated circuit elements 104 or ejection elements 401, a high density nozzle matrix on a fluid ejection module can be formed. As shown in FIG. 9, the high density matrix can have nozzles and/or piezoelectric actuators arranged in rows and columns. For example, the nozzles can be arranged in a matrix of 32 rows by 64 columns. When a media is passed below a print bar, the nozzles can eject fluid onto the media in a single pass in order to form a line of pixels on the media with a density, or print resolution, greater than 600 dpi, such as 1200 dpi or greater.

To achieve a printer resolution of greater than 600 dpi, such as 1200 dpi or greater, there can be between 550 and 60,000 nozzles and/or piezoelectric actuators 401, for example 2,000 nozzles and/or actuators, in less than one square inch. The area containing the nozzles and/or actuators, e.g., the area between the fluid inlets and outlets, can have a length greater than one inch, e.g., about 44 mm in length, and a width less than one inch, e.g., about 9 mm in width.

Fluid droplets that are between 0.01 pL and 100 pL in size, such as 2 pL, can be ejected from the nozzles. For example, there can be 2,048 nozzles and/or actuators in an area of less than one square inch when 2 pL of fluid is ejected from nozzles having an area of about 12.5 microns by 12.5 microns. There can be about 60,000 nozzles and/or actuators in less than one square inch using a fluid droplet size of 0.01 pL. Likewise, there could be about 550 nozzles and/or actuators in less than one square inch using a fluid droplet size of 100 pL. In part, such high density of nozzles, and thus single-pass resolution, can be achieved because there can be fewer input traces than independently activatable actuators.

The area of the surface of the die 103 that contains the nozzles can be, for example, about 43.71 mm by 15.32 mm, and can be larger than the area of the nozzle matrix adjacent to the die 103 in order to include room for the integrated circuit element 104, traces 403, and ink inlets and outlets 101 and 102. The high density matrix can be enhanced through the use of a silicon substrate in which small flow paths can be etched and through the etching of piezoelectric actuators. The etching of piezoelectric actuators is described further in U.S. Application No. 61/055,431, filed May 22, 2008, which is incorporated herein by reference.

This high density nozzle matrix can, for example, be electrically connected to a flex circuit without the electrical connection problems that can result from a high density of electrical contacts on both the flex circuit and the die. The pitch of electrical contacts on the die is not as fine as may be required if an electric contact between the flex circuit and die were required for each individual ejection element.

Not only are fewer contacts or contacts with greater pitches on two components easier to align with one another than more densely packed contacts, but the effects of any changes in pitch due to different thermal coefficient of the materials of the components can be reduced. In some embodiments, the die 103 is formed of silicon and the flex circuit 201 is formed on a plastic substrate, such as polyimide. When the flex circuit 201 is heated, the plastic has a tendency to shrink. Silicon, on the other hand, is less likely to change in size due to changes in temperature or changes in size to a different extent than the plastic. If the flex circuit 201 and die 103 are heated, because of a difference in thermal expansion between the two materials, the pitch of the traces can change more on one component than the other. When fewer traces are required on two components being bonded together, and when the traces are made wider, then any difference in the thermal expansion between the material from which the die is formed and the material of the flex circuit, e.g., expansion or shrinkage of one of the components, can be less likely to cause a misalignment of the traces on the two components.

In some embodiments, the traces on one of the components, such as the die 103, are formed to be wider than on the other component, but still have sufficient non-conductive space between the traces to prevent shorting or cross-talk between the traces. NCP or ACP can require heat to secure a bond. Thus, fewer traces on the die or on the flex circuit means that NCP or ACP can be used to bond the flex circuit to the die without concern about expansion or shrinkage due to heating the materials to secure the bond. A flex circuit having a pitch of about 25 microns or greater can be used with NCP or ACP without concern about expansion or shrinkage.

The integrated circuit element 104 can be made of a material with a similar coefficient of thermal expansion to the die, such as silicon or a hybrid circuit having a ceramic substrate. Thus, when the integrated circuit element and die are heated, both components either change little in size with respect to one another, do not change in size or change the same amount as one another.

Moreover, because there are more input pads 402 on the die 103 than input traces 403, the input pads 402 generally will have a finer pitch than the input traces 403. Similarly, the integrated circuit elements 104 will have a similarly fine pitched set of output pads 303. Thus, the die 103 and integrated circuit element 104 can be bonded together, for example, with paste such as NCP or ACP. Advantageously, the die 103 and the integrated circuit element 104 can be formed of materials that have a small difference of thermal expansion such that any gap or misalignment that might occur because of a difference in the thermal expansion of the materials is minimized. In some embodiments, the integrated circuit element 104 and die 103 are formed of the same material. Therefore, an induced gap between the input pads on the die and the output pads on the integrated circuit element due to bonding can be reduced or eliminated.

Returning to FIG. 6, the fluid ejector includes an interposer 105 to separate the fluid ejection elements 401 from the external environment. The interposer 105 can be made of a material with the same or similar coefficient of thermal expansion as the die 103, such as silicon, in order to prevent stress between the two components. Although it is not required, the fluid ejector can further include an upper interposer 106.

As shown in FIGS. 2 and 6, the lower interposer 105 can include a main body 430 and flanges 432 that project down from the main body 430 to contact the die 103 in a region between the integrated circuit elements 104 and the actuators 401, e.g., over the inlets 412 and outlets 414. In particular, there can be a flange 432 for each inlet 412 and outlet 412, with the passages 212 and 216 extending through the flanges 432. The flanges 432 hold the main body 430 over the die 103 to form a cavity 434. This prevents the main body 430 from contacting and interfering with motion of the actuators 401. In some implementations (shown in FIG. 2), an aperture is formed through the membrane layer 180, as well as the layers of the actuator 401 if present, so that the flange 432 directly contacts the flow-path body 182. Alternatively, the flange 432 could contact the membrane 180 or the another layer that covers the substrate 122. In addition, in some implementations, some flanges extend to contact the die over the traces 407 between the rows of actuators 401.

The interposer 105 can insulate the fluid ejection elements (e.g., adhesive, such as BCB, conductive electrodes, piezoelectric material, etc.) both electrically and thermally, as well as from any surrounding fluid coming from the fluid inlet 101 or fluid outlet 102.

The lower interposer 105 can be bonded to the die 103, for example with an adhesive such as SU-8, BCB, or epoxy, such as Emerson & Cuming Eccobond® E 3032. The upper interposer 106 can be bonded to the lower interposer 105, for example with an adhesive such as SU-8, BCB, or epoxy, such as Emerson & Cuming Eccobond® E 3032. Additionally, an adhesion promoter (e.g., silanes, such as methacrylates, mercaptopropyltrimethyloxysilane (MPTMS), aminopropyltriethoxysilane (APTES), and hexamethyldisilazane (HDMS)), can be used with the adhesive to improve the bond between the die 103 and the lower interposer 105 and between the lower interposer 105 and the upper interposer 106. Furthermore, the surfaces of the interposers 105 and 106 and the die 103 can be treated with argon to enhance the bonding between the adhesion promoter and the surfaces of the interposers 105 and 106 and the die 103. The adhesive and the adhesion promoter can be applied to the lower interposer 105, upper interposer 106, or die 103, by spin coating, vapor deposition, dipping the parts into a bath, spray coating, or any other known method. When bonding elements together, the adhesive and adhesion promoter can be applied to one or more of the lower interposer 105, the upper interposer 106, and the die 103.

When bonding the lower interposer 105 to the die 103, the lower interposer 105 can be bonded to a surface having a low total thickness variation (TTV), such as the membrane or the base substrate of the die 103. The membrane or base substrate can be processed, for example by etching or grinding, to achieve a desired thickness having a low TTV, for example, 15 microns or less, 10 microns or less, or 5 microns or less. Bonding the lower interposer 105 to a surface having a low TTV provides a uniform bond layer and prevents fluid from leaking through the ink inlets 101 or ink outlets 102, which could cause damage to the fluid ejection elements 401 or integrated circuit elements 104.

When the lower interposer 105 and the die 103 are bonded together, the bond can be strengthened by optimizing the surface area for bonding. The larger the bonding surface area, the greater the chance of trapping air bubbles, which can weaken the bond. On the other hand, if the bonding surface area is too small, then the bond can also be weak. In one implementation, the lower interposer 105 can bond around the ink inlets 101 and ink outlets 102 using a monolithic surface having a surface area of around 120 $mm^2$ or less.

Figure 11:
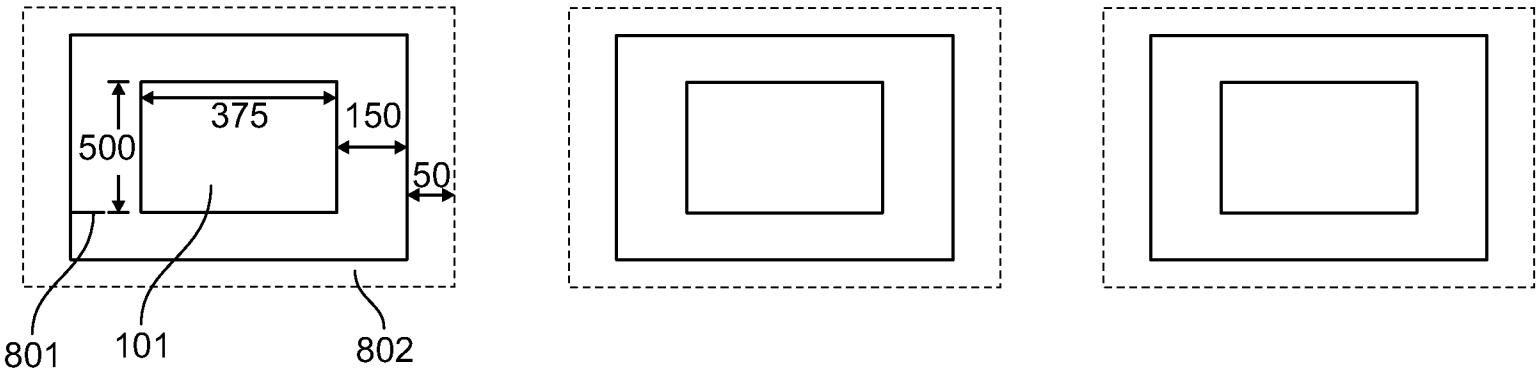
FIG. 11 is a schematic plan view of an ink outlet with an area for bonding the lower interposer to the die.

In some implementations, shown in FIG. 11, the lower interposer 105 can include smaller bonding surface areas 801 that surround each individual inlet 101 or outlet 102 (e.g., 64 inlets and outlets). For example, the bonding surface areas on the lower interposer 105 can be shaped to match the shape of the inlets 101 or outlets 102, such as square or ring-shaped. These smaller bonding surface areas 801 can be about 25% of the ink inlet 101 area or greater, 80% or greater, 150% or greater, or 200% or greater. For example, if the area of the ink inlet 101 is about 0.188 $mm^2$, the bonding surface area 801 around the ink inlet is about 1.5 $mm^2$ or less, 0.325 $mm^2$ or less, or 0.05 $mm^2$ or less. In one implementation, a cavity is made through the membrane of the die 103 to expose the surface of the base substrate of the die 103. The size of the cavity accounts for the surface areas 801 of the lower interposer 105 that bond around each inlet 101 and outlet 102 including additional area for alignment 802. For example, the surface areas on the lower interposer 105 for each inlet 101 or outlet 102 can be about 0.15 $mm^2$ with an alignment tolerance 802 of about 0.050 mm.

The fluid ejection module 103 includes ink inlets 101 and ink outlets 102 for recirculating ink through the module. Fluid can circulated by entering the module through the fluid inlets 101 and exiting through fluid outlets 102. Although the fluid inlets 101 and fluid outlets 102 are both shown in FIG. 3 as aligned linearly and in parallel, they are not so limited in configuration. Some of the ink that circulates through the die 103 is ejected through nozzles 126. In some embodiments, the nozzles 126 are located directly beneath a corresponding fluid ejection element 401.

As mentioned, in some embodiments, as shown in FIGS. 4 and 10, the fluid ejector can include an upper interposer 106. The short sides 701 or width of the upper interposer 106 can be greater than those of the lower interposer 105, though they need not be. That is, the upper interposer 106 can be wider than the lower interposer 105. The upper interposer 106 and lower interposer 105 can have the same length. The upper interposer 106 can rest on top of the lower interposer 105 and on the tops of the integrated circuit elements 104. This configuration eases the manufacturing process, for example, by allowing the integrated circuit element 104 to be placed on either side of the lower interposer 105 while still being protected by the upper interposer 106 rather than requiring a single lower interposer 105 to be etched or notched-out to accounted for the integrated circuit elements 104.

As shown in FIGS. 4 and 10, the fluid inlets 101 and fluid outlets 102 allow for flowing fluid through the interposers and through the die 103. The section of the fluid inlets 101 and fluid outlets 102 through the lower interposer 105 align with the fluid inlets 101 and fluid outlets 102 of the die 103. The section of the fluid inlets 101 and fluid outlets 102 are in the upper interposer 106 can be shifted to the center of the upper interposer 106 in comparison with a location of the section of the fluid inlets and outlets 602 that are in the lower interposer 105 and the die 103. Advantageously, this configuration allows the upper interposer 106 to be free of inlets and outlets at a perimeter of the interposer. This allows other components, such as the die cap 107 to be adhered to the perimeter of the interposer without blocking any fluid apertures. Further, this configuration shifts the fluid inlets 101 and fluid outlets 102 closer to the center of the upper interposer 106 to prevent excessive adhesive that may be present from bonding the die cap to the interposer from flowing into the fluid inlets 101 and fluid outlets 102.

Referring to FIG. 4, in some embodiments, the upper interposer 106 has fluid inlets 102 formed in a top surface of the interposer and extend down through the interposer. A fluid path 610 extending from the fluid inlet 101 can extend perpendicular to a top surface of the upper interposer 106. At a bottom surface of the upper interposer 106, that is, at the surface that contacts the lower interposer 105, a horizontal portion 612 of the fluid path 610 and extends away from a center of the upper interposer 106 toward a periphery of the upper interposer 106. In some embodiments, the horizontal portion 612 is in the bottom surface of the upper interposer 106. In some embodiments, the horizontal portion 612 is embedded in the upper interposer 106. Some portion of the horizontal portion 612, such as an end of the horizontal portion 612, is fluidly coupled to a lower interposer portion 614 of the fluid path 610. The portion of the fluid path 610 that extends to a bottom of the lower interposer 105 is in fluid connection with an inlet in a top surface of the die 103. In some embodiments, a bottom surface of the die 103, opposite to the top surface of the die 103, includes nozzles 606 for ejecting fluid. Although not shown, multiple nozzles can be formed along the recirculation path in the die, between a fluid inlet in the die and a fluid outlet in the die.

In alternative embodiments, the horizontal portion of the fluid path 610 is not formed in the upper interposer 106, but rather is formed in an upper surface of the lower interposer 105. In some embodiments, the upper interposer 106 and the lower interposer 105 each include part of the horizontal portion. In some embodiments, the fluid path in formed at an angle to the top and bottom surfaces of the interposers 105 and 106.

In some embodiments, the lower interposer 105 directly contacts, with or without a bonding layer therebetween, the die 103, and the upper interposer 106 directly contacts, with or without a bonding layer therebetween, the lower interposer 105. Thus, the lower interposer 105 is sandwiched between the die 103 and the upper interposer 106. The flex circuits 201 are bonded to a periphery of the die 103 on a top surface of the die 103. The die cap 107 can be bonded to a portion of the flex circuit 201 that is bonded to the die 103. The flex circuit 201 can bend around the bottom of the die cap 107 and extend along an exterior of the die cap 107. The integrated circuit elements 104 are bonded to an upper surface of the die 103, closer to a central axis of the die 103, such as a central axis that runs a length of the die 103, than the flex circuits 201, but closer to a perimeter of the die 103 than the lower interposer 105. In some embodiments, the side surfaces of the lower interposer 105 are adjacent to the integrated circuit element 104 and extend perpendicular to a top surface of the die 103.

While preferred embodiments of the invention have been described, it should be understood that these are exemplary of the invention and that various modifications can be made without departing from the spirit or scope of the invention. For example, the actuators described above are piezoelectric actuators on a top surface of the die opposite to the nozzle, the actuators could be heating elements and/or be embedded in the die 103 or proximate to the nozzle.

What is claimed is:

1. A fluid ejector, comprising:

a fluid ejection module comprising a substrate having a plurality of fluid paths, a plurality of actuators, and a plurality of conductive traces, each actuator configured to cause a fluid to be ejected from a nozzle of an associated fluid path;

an integrated circuit element, wherein the integrated circuit element is mounted on the substrate and is electrically connected with the conductive traces of the fluid ejection module such that an electrical connection of the fluid ejection module enables a signal sent to the fluid ejection module to be transmitted to the integrated circuit element, processed on the integrated circuit element, and output to the fluid ejection module to drive each of the actuators; and a flexible element in electrical connection with the fluid ejection module such that the signal sent to the fluid ejection module is transmitted from the flexible element, wherein:

the fluid ejection module comprises a plurality of input traces and a plurality of first input pads, wherein the input traces are electrically connected to the flexible element, and wherein the first input pads are electrically connected respectively to the actuators;

the integrated circuit element comprises a plurality of integrated switching elements, a plurality of second input pads connected respectively to the input traces of the fluid ejection module, and a plurality of output pads connected respectively to the first input pads of the fluid ejection module, wherein the integrated switching elements are connected respectively to the second input pads and the output pads; and the number of input traces is smaller than the number of output pads.

2. A fluid ejector as in claim 1, wherein the fluid ejection module is formed of silicon.

3. A fluid ejector as in claim 1, wherein each of the actuators includes a piezoelectric element.

4. A fluid ejector as in claim 1, wherein each of the actuators includes a heater element.

5. A fluid ejector as in claim 1, wherein the fluid ejection module and the integrated circuit element are adhered with a non-conductive paste.

6. A fluid ejector as in claim 1, wherein the fluid ejection module and the integrated circuit element are adhered with an anisotropic paste.

7. A fluid ejector as in claim 1, wherein the flexible element is formed on a plastic substrate.

8. A fluid ejector as in claim 1, wherein the second input pads and the output pads are located on a surface of the integrated circuit element that is adjacent to the fluid ejection module.

9. A fluid ejector as in claim 1, wherein the number of output pads and the number of fluid ejection elements are equivalent.

10. A fluid ejector as in claim 1, wherein:

the number of output pads is less than the number of actuators; and there is a plurality of integrated circuit elements for a single fluid ejection module.

11. A fluid ejector as in claim 1, wherein the first input pads and the output pads are adjacent to each other.

12. A fluid ejector as in claim 1, wherein the input traces and the second input pads are adjacent to each other.

13. A fluid ejector as in claim 1, wherein the flexible element and the input traces are adhered together with a non conductive paste.

14. A fluid ejector as in claim 1, wherein the flexible element and the input traces are adhered together with an anisotropic paste.

* * * * *